US006682438B2

(12) United States Patent
Lee

(10) Patent No.: US 6,682,438 B2
(45) Date of Patent: Jan. 27, 2004

(54) MECHANICAL GOLF BALL FEED APPARATUS

(76) Inventor: Chong Dae Lee, 7077 Poppleton, Canton, MI (US) 48187

( * ) Notice: Subject to any disclaimer, the term of this patent is extended or adjusted under 35 U.S.C. 154(b) by 0 days.

(21) Appl. No.: 10/307,808

(22) Filed: Dec. 2, 2002

(65) Prior Publication Data

US 2003/0171158 A1 Sep. 11, 2003

Related U.S. Application Data

(63) Continuation-in-part of application No. 10/092,706, filed on Mar. 7, 2002.

(51) Int. Cl.[7] ..... A63B 57/00
(52) U.S. Cl. ..... 473/137; 473/134
(58) Field of Search ..... 473/132–137

(56) References Cited

U.S. PATENT DOCUMENTS 4,265,453 A * 5/1981 Loof ..... 473/134
4,441,717 A * 4/1984 Willcox ..... 473/134
5,016,886 A * 5/1991 Gould ..... 473/135
5,464,223 A * 11/1995 Dermott ..... 473/134
5,895,325 A * 4/1999 Tomey ..... 473/134
6,315,676 B1 * 11/2001 Sandlin ..... 473/137

* cited by examiner

*Primary Examiner*—Steven Wong
(74) *Attorney, Agent, or Firm*—Thomas E. Donohue Esq.

(57) ABSTRACT

An automatic mechanical golf ball feed apparatus 10 is provided, including a hopper 12 for housing a plurality of golf balls 14, and a gravity driven delivery arm 18 including a counterweight end 22 and a ball delivery end 20, the gravity driven delivery arm 18 being rotatably movable between a loaded position 28 and a delivery position 30. The present invention further includes a chute 16 in communication with the hopper 12 and receiving the plurality of golf balls 14 from the chute 16. An impact gate 52 is positioned between the chute 16 and said gravity driven delivery arm 18, the impact gate 52 including a ball restraint pivot element 80 having a weight biased end 82. The impact gate 52 is rotatable between a gate closed position 84, wherein the plurality of golf balls 14 are restrained from exiting the hopper 12, and a gate open position 86 wherein one of the golf balls 14 is allowed to exit the hopper 12.

15 Claims, 9 Drawing Sheets

MECHANICAL GOLF BALL FEED APPARATUS

CROSS-REFERENCE TO RELATED APPLICATIONS

This is a continuation-in-part of U.S. patent application Ser. No. 10/092706, filed on Mar. 7, 2002.

TECHNICAL FIELD

The present invention relates generally to a mechanical golf ball feed apparatus and more particularly, to an automatic mechanical apparatus for continuously placing golf balls onto a tee.

BACKGROUND OF THE INVENTION

A popular axiom in the sport of golf is that improvement cannot be achieved without practice. This has helped drive the popularity and success of driving ranges wherein a golfer can practice multiple golf shots in order to diagnose or improve his game. Traditional driving range methodologies commonly dictate the golfer remove a ball from a basket, bend over and place it on the tee, position himself, swing the club to drive the ball, and repeat the procedure. Although this method may be commended for its simplicity, it can pose both an inconvenience as well as an interference towards effective practice. The golfer using standard driving range techniques must break his stance after every swing in order to replace the golf ball on the tee. This interferes with the golfer's ability to develop a feel for a proper swing. The feel of a proper swing is believed by many to be a cornerstone of game improvement. By requiring the golfer to break his stance, position, and mental concentration in order to re-tee up another ball, the traditional driving range techniques leave considerable room for improvement.

One redress for the problems associated with traditional driving ranges has been through the use of automated golf ball teeing apparatuses. These systems have been designed to accommodate electrically powered teeing, mechanically driven teeing, and combination systems. Although numerous systems and apparatuses have been developed for automated teeing, often these systems incorporate elements that render them impractical or undesirable for actual implementation on a driving range. Electrically powered teeing systems, for example, can require electrical wiring and extensive retrofitting of present ranges. Driving ranges, however, are often operated on a low budget cost structure that renders such retrofitting impractical. In addition, remote location and exposure to the elements can further reduce the desirability of electrical systems. Also not to be overlooked, routine maintenance, damage repair, and product failure must often be handled by the driving range staff. Electrical systems can require technical expertise and costly maintenance that may not be practical or desirable in many driving range scenarios.

Mechanical systems are often utilized in an attempt to minimize the undesirable factors associated with electrical systems. Often, however, these designs incorporate their own set of flaws that hamper their performance or their practical implementation. One such category of mechanical designs can be identified as user actuated mechanical designs. User actuated mechanical designs, as opposed to fully automated designs, require the golfer to press down on a petal or push down on a delivery arm to place a ball on the tee. Although these systems can be less intrusive than traditional driving range methodologies, they still require the golfer to mentally break from the golfing mode to actuate a teeing operation. In this sense they still interfere with a golfer's ability to develop a consistent feel or swing. Additionally, often these systems employ a delivery slide. Delivery slides utilize gravity to roll the golf ball down an incline towards an aperture at the end of the slide. The aperture is positioned above the tee such that the ball is deposited on the tee. This method of delivery, however, imparts momentum onto the ball as it reaches the aperture. This momentum can negatively impact the ability of the teeing system to place the ball statically on the tee. Consistently placing the ball on the tee and having it remain there statically can be a fundamental characteristic of a reliable teeing system.

Fully automated systems often employ the delivery slide method as well. These systems can further exacerbate the problem of ball momentum as they are not held down in position by the golfer until the ball settles. Often, the delivery arm, or slide, in these systems automatically returns to an upright position upon the ball entering the aperture at the end of the slide. In these systems, the ball can encounter jostling forces from the returning arm in addition to the momentum induced by the slide. All of these forces on the golf ball can increase the difficulty of placing the ball successfully on the tee and having it remain there until hit. In addition, many automated mechanical systems employ complex systems of gates and actuators to deliver a golf ball to the delivery arm. As the complexity of these systems increases, so does the opportunity for failure and associated maintenance costs. Some systems have tied ball delivery to the impact of the tee by the golf club. These systems can incur high impact stress and thereby further increase the cost of design, maintenance and operation. Finally, some systems require the golfer to pre-load the first golf ball on either the tee or into the delivery arm. This can effect the golfer's perceived ease of operation and can require the golfer to be instructed on the system' operation. This can decrease the attractiveness of such a system to driving range operators.

It would, therefore, be highly desirable to have an automated mechanical golf ball feed apparatus with reduced ball momentum on delivery, reduced complexity of operation, robust operation, and increased ease of operation.

SUMMARY OF THE INVENTION

It is, therefore, an object of the present invention to provide an automatic mechanical golf ball feed apparatus without the need for electronic components. It is a further object of the present invention to provide an automatic mechanical golf ball feed apparatus with improved ball delivery, user interaction, and operation.

In accordance with the objects of the present invention, an automatic mechanical golf ball feed apparatus is provided. The automatic mechanical golf ball feed apparatus includes a gravity driven delivery arm having a counterweight end and a ball delivery end. The gravity driven delivery arm is movable between a loaded position and a delivery position. The automatic mechanical golf ball feed apparatus further includes a chute in communication with a hopper for dispensing a plurality of balls to a delivery chamber mounted on the gravity driven delivery arm. An impact gate is positioned between the chute and the gravity driven delivery arm. The impact gate includes a ball restraint pivot element having a weight biased end. The impact gate is rotatable between a gate closed position, wherein the plurality of golf balls are restrained from exiting the hopper, and a gate open position wherein one of the golf balls is allowed to exit the hopper.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
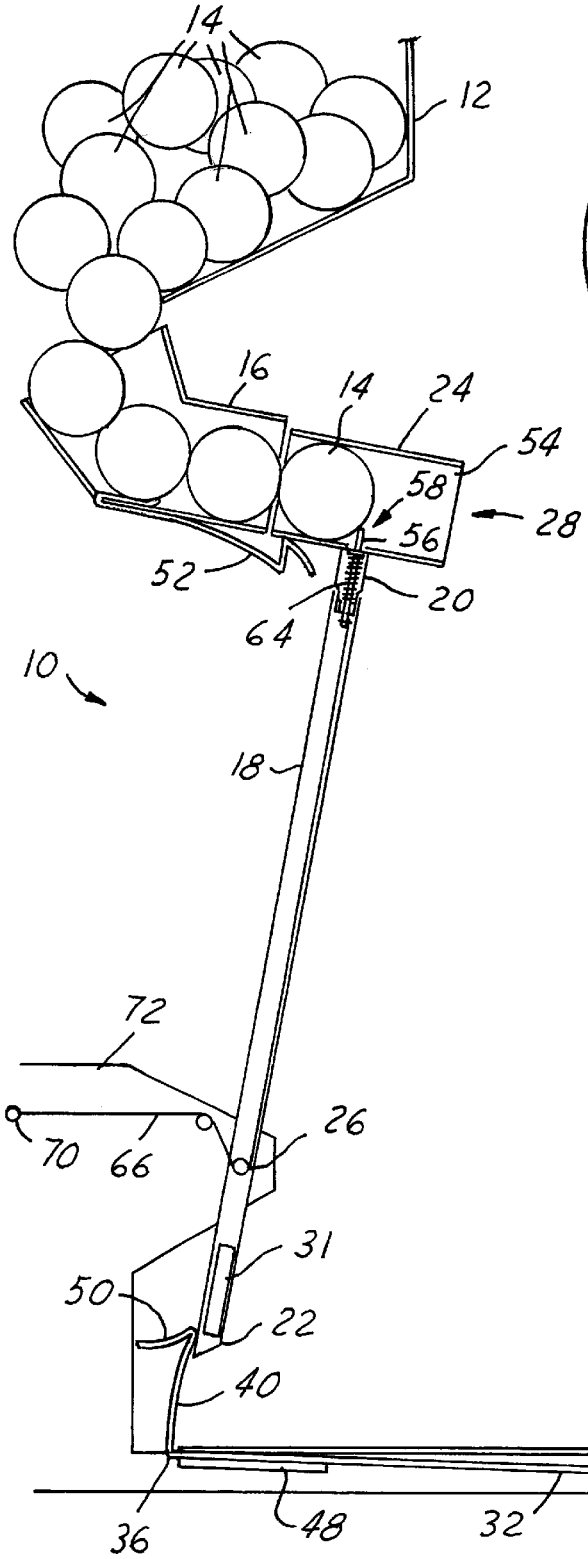
FIG. 1 is an illustration of an embodiment of an automatic mechanical golf ball feed apparatus in accordance with the present invention, the automatic mechanical golf ball feed apparatus illustrated in the loaded position.

Referring now to FIG. 1, illustrating an embodiment of an automatic mechanical golf ball feed apparatus 10 in accordance with the present invention. The present invention is intended for use on golf course driving ranges. It is utilized to automatically and continuously replace the golf ball struck by a golfer off the tee with a new golf ball. It is contemplated, however, that the present invention may be utilized by a variety of alternate applications such as golf simulation machines and golf shop demonstration areas.

Figure 4:
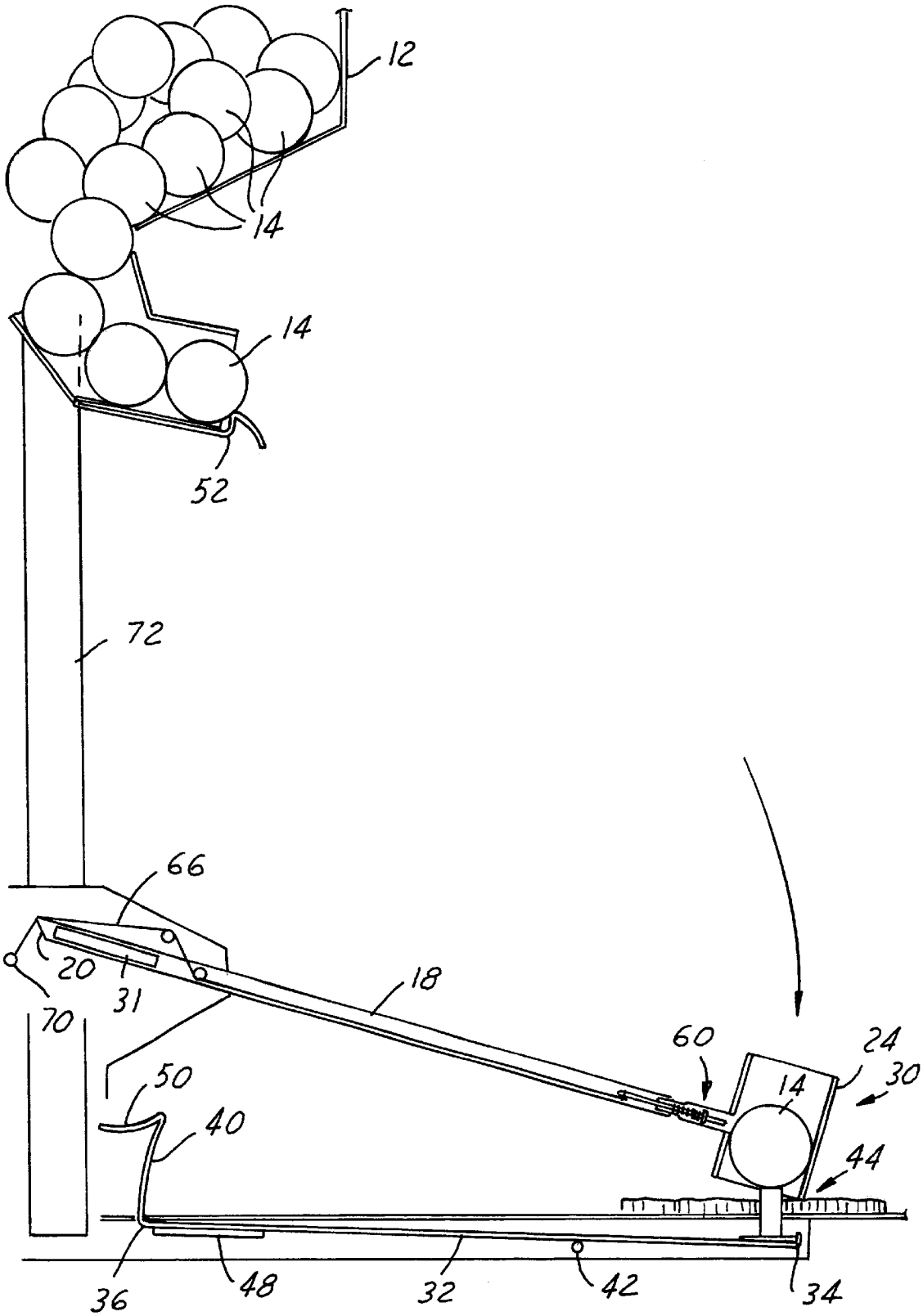
FIG. 4 is an illustration of the embodiment of an automatic mechanical golf ball feed apparatus shown in FIG. 1, the automatic mechanical golf ball feed apparatus illustrated in the delivery position.

The automatic mechanical golf ball feed apparatus 10 includes a hopper 12 capable of storing a plurality of golf balls 14. The customer, using a basket of purchased golf balls, commonly fills the hopper 12. It is possible, however, for a dispensing system to be utilized in combination with the present invention to fill the hopper 12. The golf balls 14 are supplied to a chute 16 where they are directed into communication with a gravity driven delivery arm 18. The gravity driven delivery arm 18 includes a ball delivery end 20 and a counterweight end 22. A delivery chamber 24 positioned on the delivery end 20 of the gravity driven arm 18 can be placed in communication with the chute 16 to receive a golf ball 14 from the hopper 12. The gravity driven delivery arm 18 is rotatably movable about a pivot position 26 such that it moves between a loaded position 28 as illustrated in FIG. 1 and a delivery position 30 as illustrated in FIG. 4. The counterweight end 22 can contain counterweight elements 32 in order to bias the gravity driven delivery arm 18 towards the loaded position 28 when there is not a golf ball 14 in the delivery chamber 24, and bias the gravity driven delivery arm 18 towards the delivery position 30 when a golf ball 14 is present in the delivery chamber 24.

Figure 2:
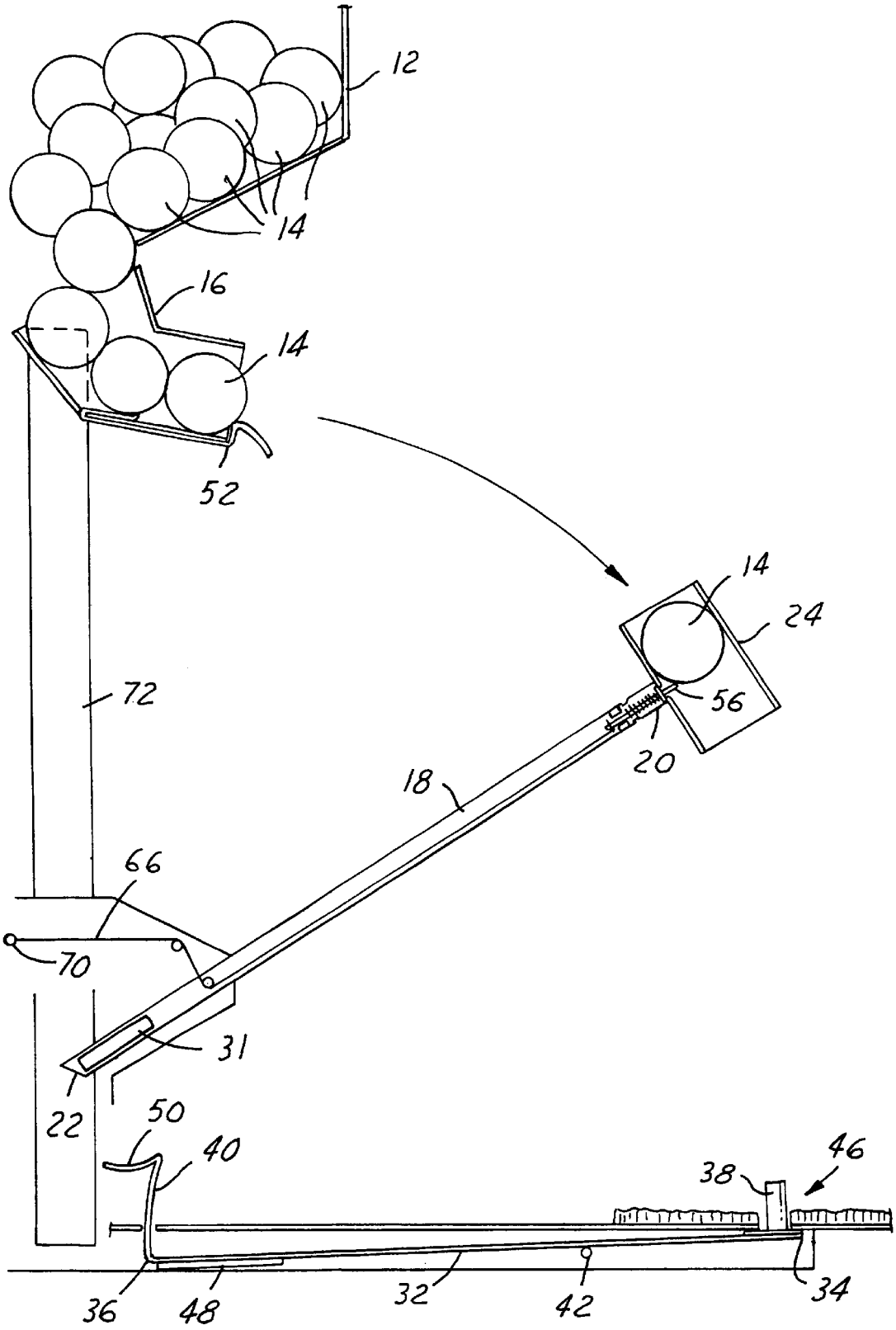
FIG. 2 is an illustration of the embodiment of an automatic mechanical golf ball feed apparatus shown in FIG. 1, the automatic mechanical golf ball feed apparatus illustrated in transit between the loaded position and the delivery position.
Figure 3:
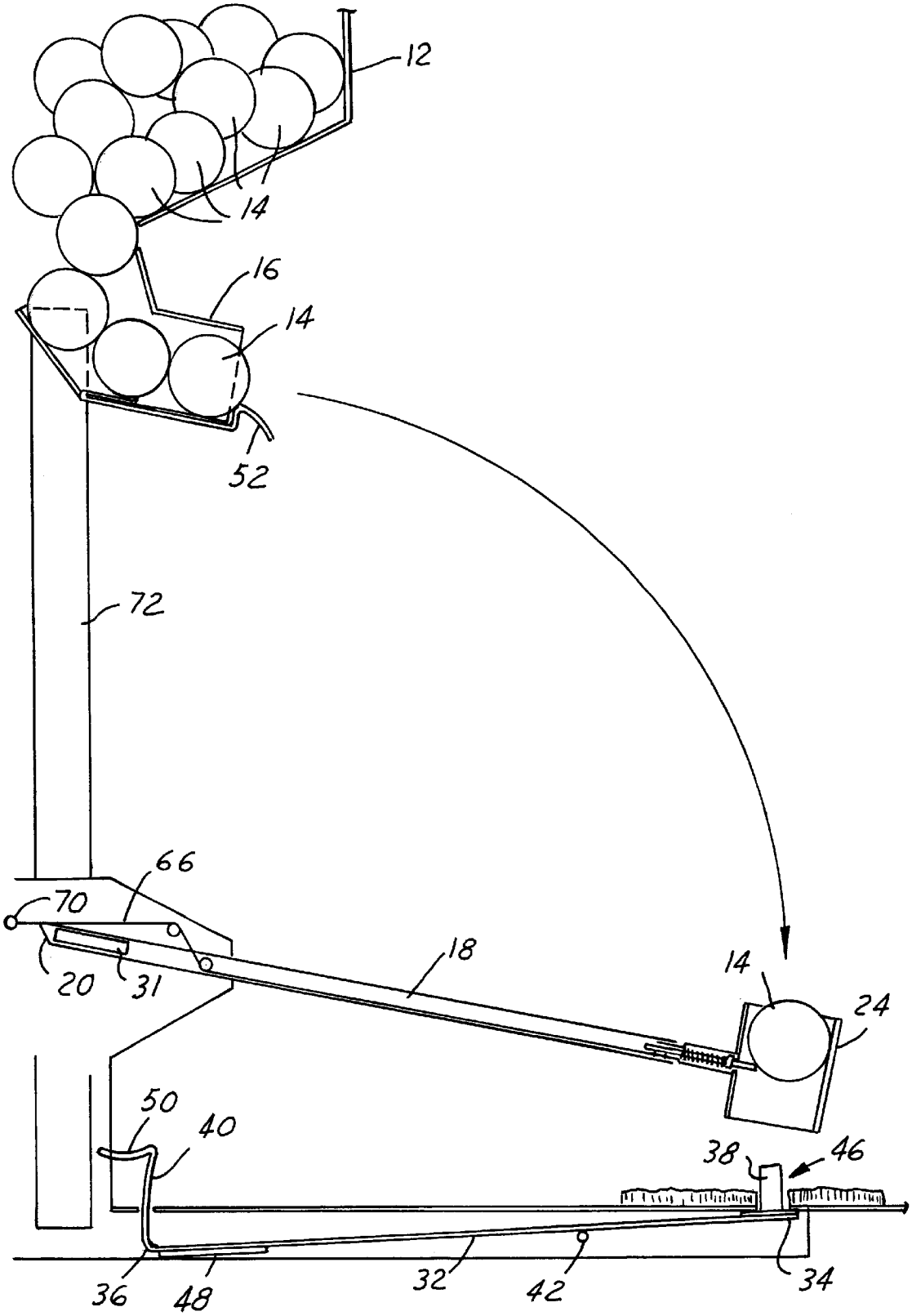
FIG. 3 is an illustration of the embodiment of an automatic mechanical golf ball feed apparatus shown in FIG. 1, the automatic mechanical golf ball feed apparatus illustrated in continuing transit between the loaded position and the delivery position.

The present invention regulates the movement of the gravity driven delivery arm 18 through the use of a baseline pivot arm 32. The baseline pivot arm 32 is an arm having a tee end 34 and a lock end 36. A tee 38 is positioned on the tee end 34 and a locking arm 40 is positioned on the lock end 36. The baseline pivot arm 32 pivots about a fulcrum 42 such that it is movable between a ball-weighted position 44 as shown in FIG. 1 and a ball free position 46 as shown in FIG. 4. When a golf ball 14 is positioned on the tee 38, the tee end 34 is weighted down and the lock end 36 is thereby raised. When the lock end 36 is raised, the locking arm 40 engages the gravity driven delivery arm 18 and thereby prevents its movement from the loaded position 28 towards the delivery position 30. Thus when the golf ball 14 is driven by the golfer off the tee 38, the baseline pivot arm 32 is biased back into the ball free position 46, the lock end 36 is lowered, and the lock arm 40 disengages the gravity driven delivery arm 18 allowing it to move towards the delivery position 30 (see FIGS. 2 and 3) to replace the golf ball driven from the tee 38. The action of the baseline pivot arm 32 can be adjusted through the positioning of the fulcrum 42 as well as baseline weights 48 attached to the lock end 36. Furthermore, the lock arm 40 can have a bypass surface 50 that allows the gravity driven delivery arm 18 to pass over the lock arm 40 on its way back from the delivery position 30 to the loaded position 28. The interacting dual gravity driven levers, the gravity driven delivery arm 18 and the baseline pivot arm 32, provide advantages over prior art design by providing a simple automatic mechanical delivery system. The impact of the delivery chamber 24 into the hopper 12 helps prevent the plurality of golf balls 14 from getting stuck before entering the chute 16. In addition, since the baseline pivot arm 32 only engages the gravity driven delivery arm 18 when a golf ball 14 is on the tee 38, the present invention provides for an automatic delivery of the first ball when the system is loaded.

In addition to the interacting dual gravity driven levers, the present invention provides further advantages over prior art designs. Often prior art designs required complex gate systems and actuators to dispense golf balls from the hopper. The present invention, however, utilizes a single impact gate 52 to control release of the golf balls 14 from the hopper 12. The delivery chamber 24 moves aside the impact gate 52 when the gravity driven delivery arm 18 is in the loaded position 28. This allows a golf ball 14 to move from the chute 16 into the delivery chamber 24. A delivery chamber 24 designed to accommodate only a single golf ball 14 when used in combination with the impact gate 52 eliminates the need for a complex arrangements of gates within the hopper to meter golf balls out one at a time. Although it is contemplated that a delivery chamber 24 designed to accommodate a single golf ball 14 may be accomplished in a variety of fashions, one embodiment contemplates the use of a unique delivery chamber 24 designed to improve the performance of the present invention.

It is contemplated that this unique delivery chamber 24 takes the form of a cylindrical chamber 54 positioned generally perpendicular to the length of the gravity driven delivery arm 18. By utilizing a cylindrical chamber 54 in this orientation, movement of the golf ball within the delivery chamber 24 as the gravity driven delivery arm 18 moves from the loaded position 28 to the delivery position 30 is minimized. Limiting the diameter of the cylindrical chamber 54 to slightly more than the diameter of the golf ball 14 further minimizes golf ball movement. The minimization of golf ball movement reduces the momentum imparted to the golf ball 14 and improves the ability of the automatic mechanical golf ball feed apparatus 10 to consistently and reliably place a golf ball 14 statically on the tee 38. In addition, it is contemplated that the present invention further include an internal gate 56 positioned within the delivery chamber 24. The use of an internal gate 56 within the delivery chamber 24 allows for the reduction of complex gates within the hopper, the use of a stable low-movement delivery chamber 24, and provides greater control of golf ball release onto the tee 38. All of these factors work together to improve the performance of the present invention. The internal gate 56 has a closed position 58, see FIG. 1, wherein the internal gate 56 serves to limit the capacity of the delivery chamber 24 to a single golf ball 14, and an open position 60, see FIG. 4, wherein the internal gate 56 allows the golf ball 14 to pass through the cylindrical chamber 54 and engage the tee 38.

Figure 6:
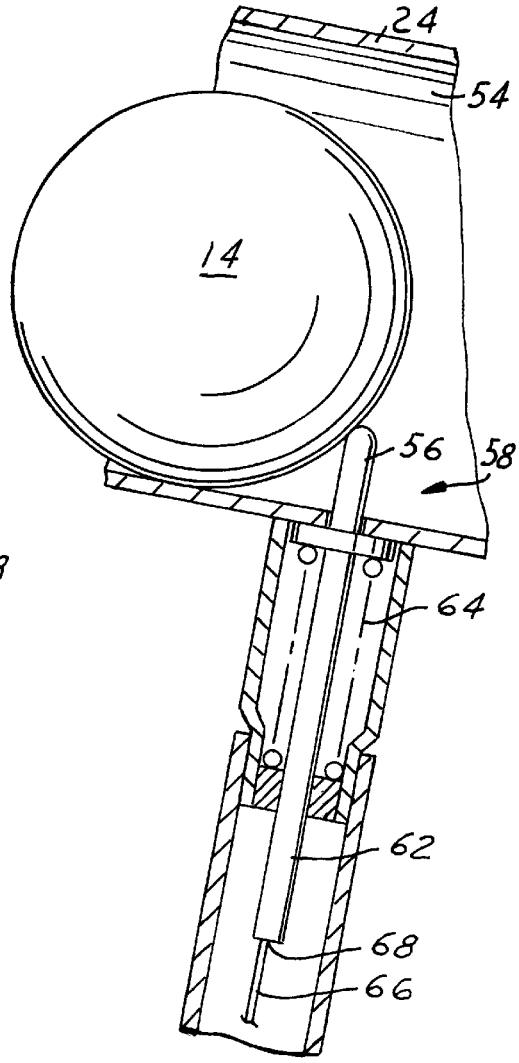
FIG. 6 is a detail illustration of the gravity driven delivery arm and delivery chamber illustrated in FIG. 1.

The internal gate 56 can take on a variety of configurations and can be actuated through a variety of means. FIG. 6 illustrates a detail of one such configuration. The internal gate 56 can be comprised of a gate element 62, a bias spring 64 and an actuator cable 66. The bias spring 52 biases the gate element 62 into the closed position 58. The actuator cable 66 has a first cable end 68 attached to the gate element 62 and wired through the gravity driven delivery arm 18. A second cable end 70 is affixed within a mounting structure 72 such that as the gravity driven delivery arm 18 approaches the delivery position 30, the counterweight end 22 comes into communication with the actuator cable 66 (see FIG. 3), lengthening the cable path and thereby pulling the gate element 62 into the open position 60. In this fashion, the length and position of the actuator cable 66 in relation to the counterweight end 22 can be adjusted to allow the internal gate 56 to release the golf ball 14 at a position above or in-contact with the tee 38. Again, although a single embodiment for an internal gate 56 and actuation mechanism 62–72 has been described, it should be understood that a wide variety of modifications would be obvious to one skilled in the art.

Figure 5:
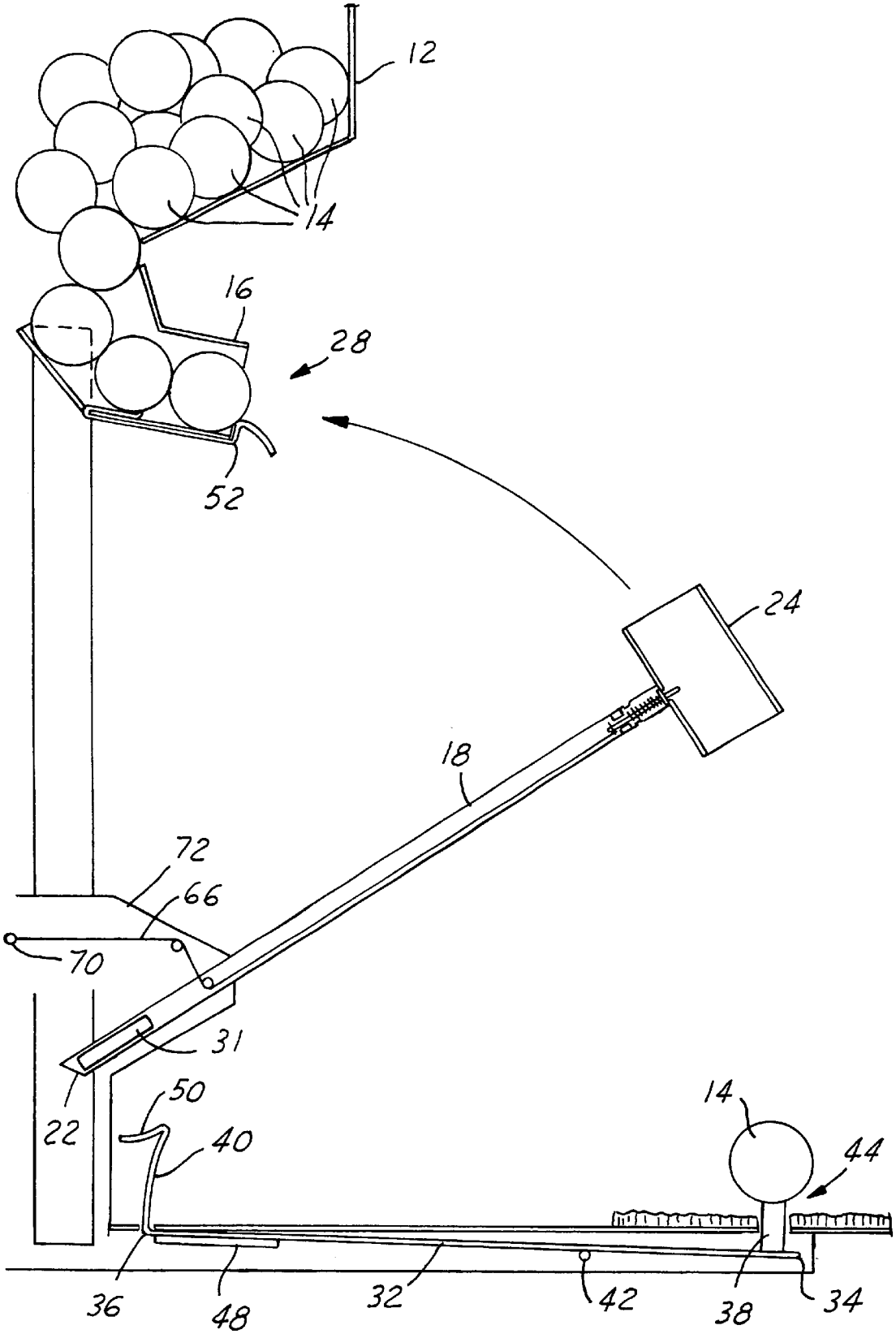
FIG. 5 is an illustration of the embodiment of an automatic mechanical golf ball feed apparatus shown in FIG. 1, the automatic mechanical golf ball feed apparatus illustrated in transit between the delivery position and the loaded position.

In operation, the present invention would function as follows. The hopper 12 is filled with a plurality of golf balls 14 sending the balls through the chute 16 and a single golf ball into the delivery chamber 24. The golf ball 14 in the delivery chamber 24 biases the gravity driven delivery arm 18 towards the delivery position 30 and thus the gravity driven delivery arm 18 pivots towards that position (see FIG. 2). As the gravity driven delivery arm 18 approaches the delivery position 30, the counterweight end 22 comes into contact with the actuator cable 66 (see FIG. 3), thereby moving the internal gate 56 into the open position 60 and allowing the golf ball 14 to settle on the tee 38 (see FIG. 4). The golf ball 14 on the tee 38 biases the baseline pivot arm 32 into the ball weighted position 44 and the gravity driven delivery arm 18, having released the golf ball 14, returns to the loaded position 28 to receive another ball (see FIG. 5). When the gravity driven delivery arm 18 reaches the loaded position 28, the impact gate 52 is moved out of the way allowing a single golf ball 14 to enter the delivery chamber 24 (see FIG. 1). The baseline pivot arm 32, being presently biased into the ball weighted position 44 and thereby having raised the locking arm 40, engages the gravity driven delivery arm 18 until the ball on the tee 38 has been hit or removed. Once the ball in the tee 38 has been hit, the process repeats itself and another golf ball 14 is automatically tee-ed up.

Figure 7:
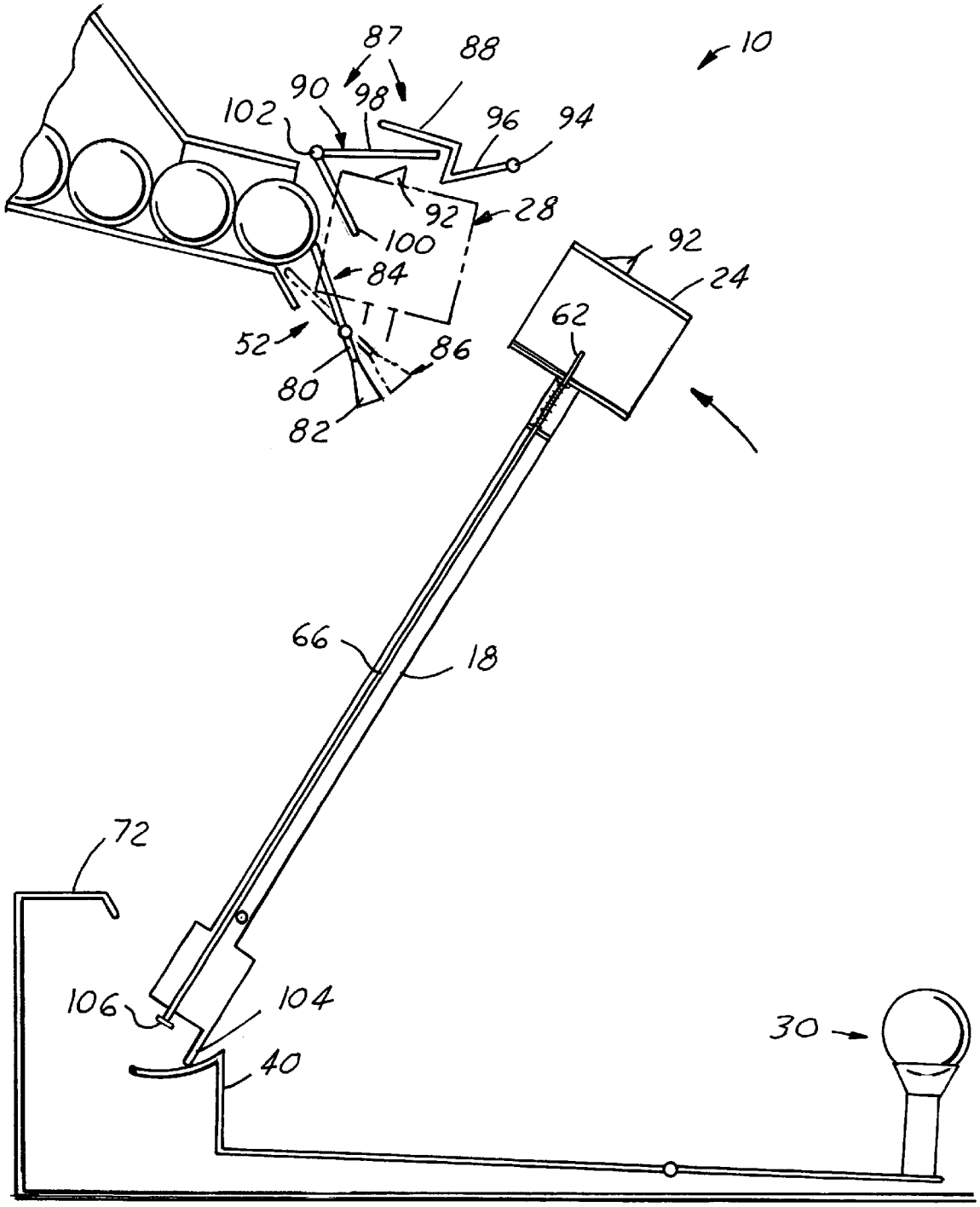
FIG. 7 is an illustration of an alternate embodiment of an automatic mechanical golf ball feed apparatus in accordance with the present invention, the automatic mechanical golf ball feed apparatus illustrated in transit between the delivery position and the loaded position.

Numerous improvements can be effectuated on the various elements of the present invention to facilitate operation and simplify construction. Although numerous improvements are contemplated, a collection of such improvements are illustrated in FIGS. 7–14. FIG. 7 illustrates an alternate embodiment of the automatic golf ball feed apparatus 10 illustrating some of these improvements, the automatic golf ball feed apparatus 10 in transit between the delivery position 30 to the loaded position 28. The impact gate 52 in this embodiment is no longer composed of a single element but rather a plurality of elements. These elements include a ball-restraint pivot element 80 utilized to keep the golf balls 14 from exiting the hopper 12. Although a variety of ball-restraint pivot elements 80 are contemplated, one embodiment contemplates the use of a gravity driven ball-restraint pivot element 80. The gravity driven ball-restraint element 80 has a weight-biased end 82 that biases the ball-restraint element 80 into the gate-closed position 84 when unencumbered. When the delivery chamber 24 moves into contact with the ball-restraint element 82 (see FIG. 8), it forces the ball-restraint element 82 into a gate-open position 86 to allow a golf ball 14 to enter the delivery chamber 24.

Figure 8:
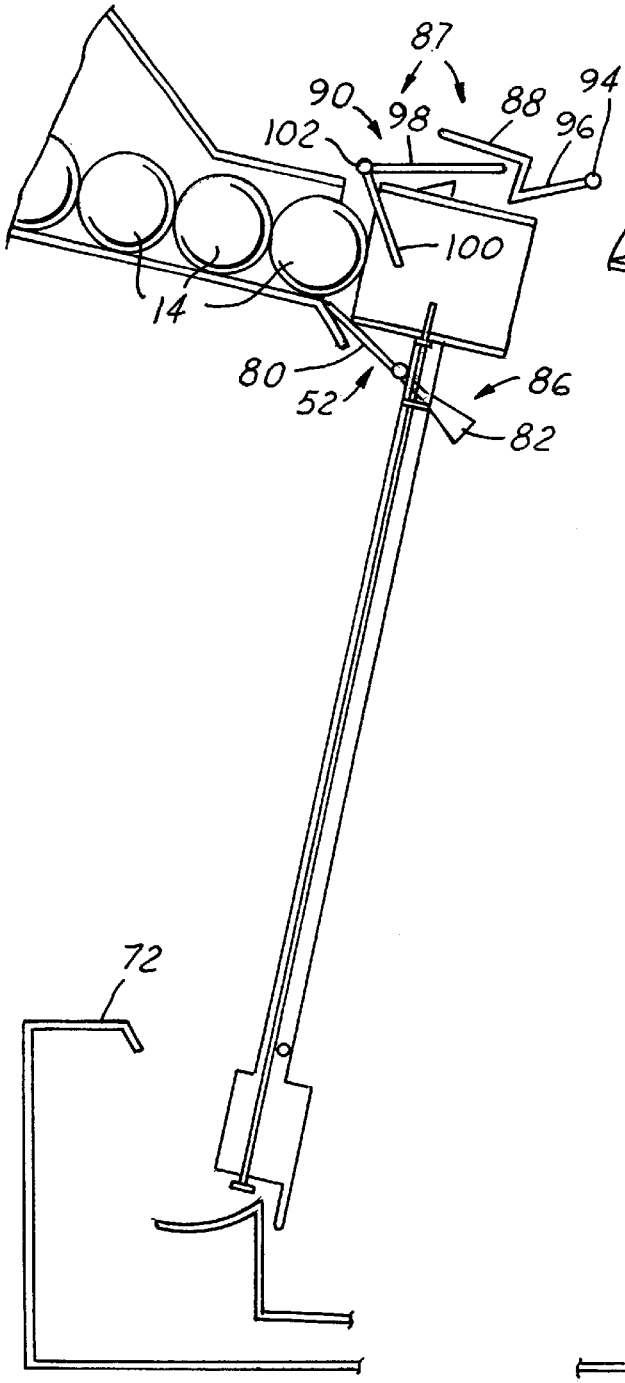
FIG. 8 is an illustration of the embodiment of an automatic mechanical golf ball feed apparatus as illustrated in FIG. 7, the automatic mechanical golf ball feed apparatus illustrated in the loading position.
Figure 9:
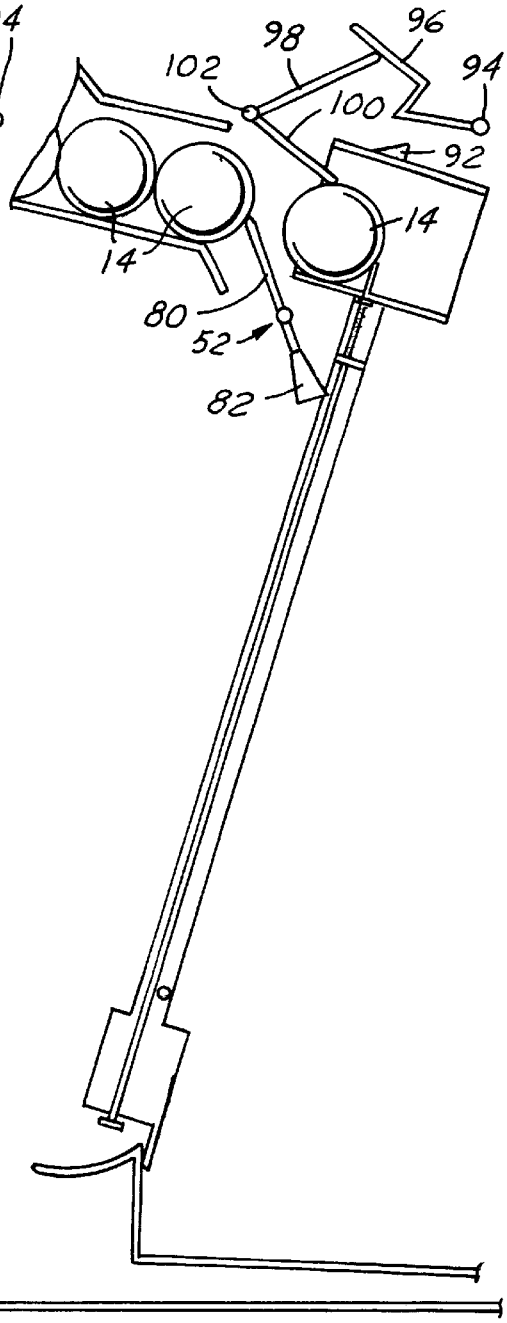
FIG. 9 is an illustration of the embodiment of an automatic mechanical golf ball feed apparatus as illustrated in FIG. 7, the automatic mechanical golf ball feed apparatus illustrated in the loaded position.
Figure 10:
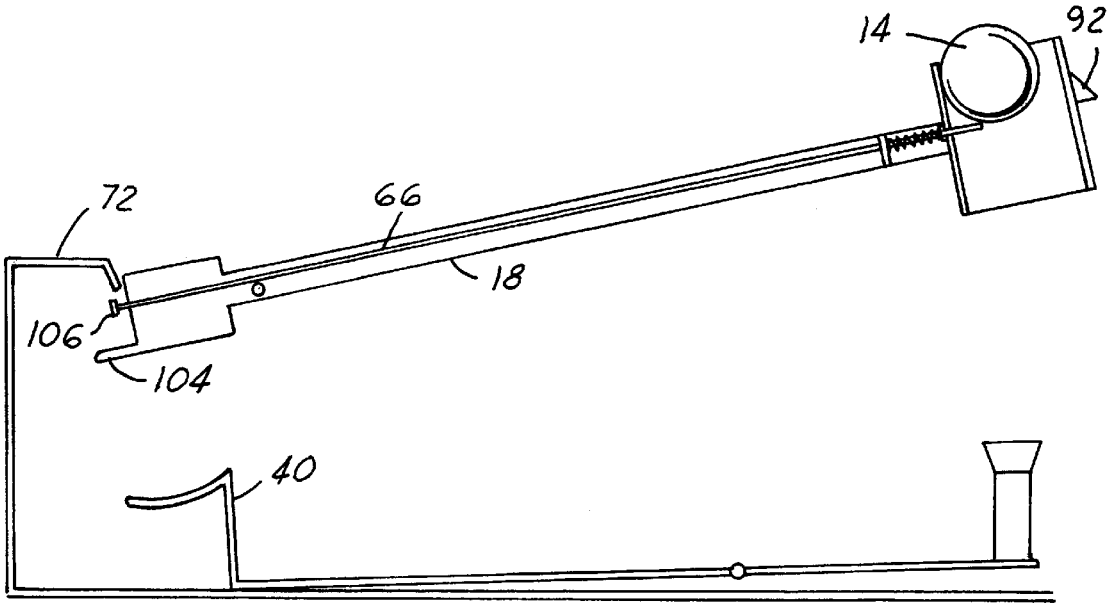
FIG. 10 is an illustration of the embodiment of an automatic mechanical golf ball feed apparatus as illustrated in FIG. 7, the automatic mechanical golf ball feed apparatus illustrated in transit between the loaded position and the delivery position.
Figure 11:
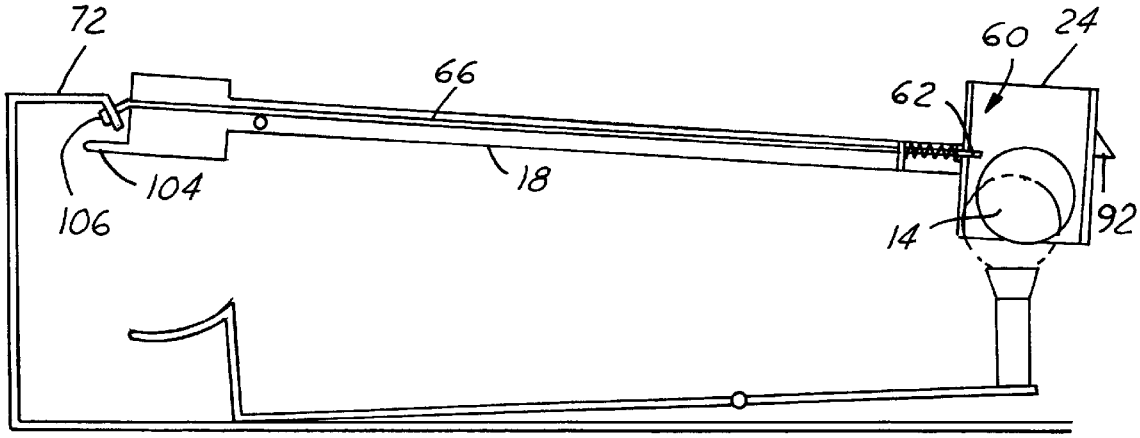
FIG. 11 is an illustration of the embodiment of an automatic mechanical golf ball feed apparatus as illustrated in FIG. 7, the automatic mechanical golf ball feed apparatus illustrated in the delivery position.

It is desirable, however, to prevent bounce-back of the delivery chamber 24 after initial contact with the impact gate 52 such that it does not move away from the chute 16 before properly loading a golf ball 14. Therefore, the impact gate 52 can further comprises a bounce-back restraint assembly 86. Although it is contemplated that the bounce-back restraint assembly 86 may be comprises of a variety of elements, one embodiment contemplates the use of a chamber restraint element 88 and a chamber release element 90. The chamber restraint element 88 is designed to engage a chamber restraint feature 92, formed on the delivery chamber 24, as the delivery chamber 24 moves into the loaded position 28 (FIG. 8). Although the chamber restraint feature 92 may be formed in a variety of fashions, one embodiment contemplates the use of a triangular catch. In this fashion, the delivery chamber 24 is prevented from bouncing away from the chute 16 prior to the loading of the golf ball 14 into the delivery chamber 24. Only when a golf ball 14 moves into the delivery chamber 24 is the chamber release element 90 tripped by the golf ball 14 and the gravity driven delivery arm 18 allowed to move away from the chute 16 (see FIG. 9). Although it is contemplated that the chamber restraint element 88 and the chamber release element 90 may interact in a variety of fashions, the illustrated embodiment describes a chamber restraint element 88 rotatable about a restraint pivot 94 and including a chamber restraint arm 96 designed to engage the chamber restraint feature 92. The chamber release element 90 includes a release actuation arm 98 affixed at an angle to a ball actuation arm 100, the combination rotatable about a release pivot 102 positioned at the location of the affixation of these two elements. When a golf ball 14 engages the ball actuation arm 100, the ball actuation arm 100 forces the release actuation arm 98 upwards into the chamber restraint arm 96. The chamber restraint arm 96 is thereby moved out of communication with the chamber restraint feature 92 and the gravity driven delivery arm 18 is free to travel once released from the locking arm 40. In this fashion difficulties with bounce-back as the delivery chamber 24 contacts the chute 16 can be simply and effectively eliminated.

The alternate embodiment illustrated in FIGS. 7 through 14 also illustrates an improvement to the actuator cable 66 and gate element 62 actuation. The prior described embodiment utilized the counterweight end 22 of the gravity driven delivery arm 18 to distend the actuator cable 66 and thereby pull back the gate element 62 when the delivery arm 18 reached the delivery position 30. The embodiment illustrated in FIGS. 7–11 refines this interaction and actuation to provide an alternative approach to actuation of the gate element 62. This embodiment includes a locking extension 104 formed onto the counter weight end 22 of the gravity driven delivery arm 18. By using the locking extension 104, the delivery arm 18 can engage the locking arm 40 while still leaving ample room at the end of the delivery arm 18 for an actuator cable tab 106. The actuator cable tab 106 is designed to engage a restraint such as the mounting structure 72 when the delivery arm 18 moves into the delivery position 30 (see FIGS. 10 and 11) such that the gate element 62 is pulled into the open position 60.

Figure 12:
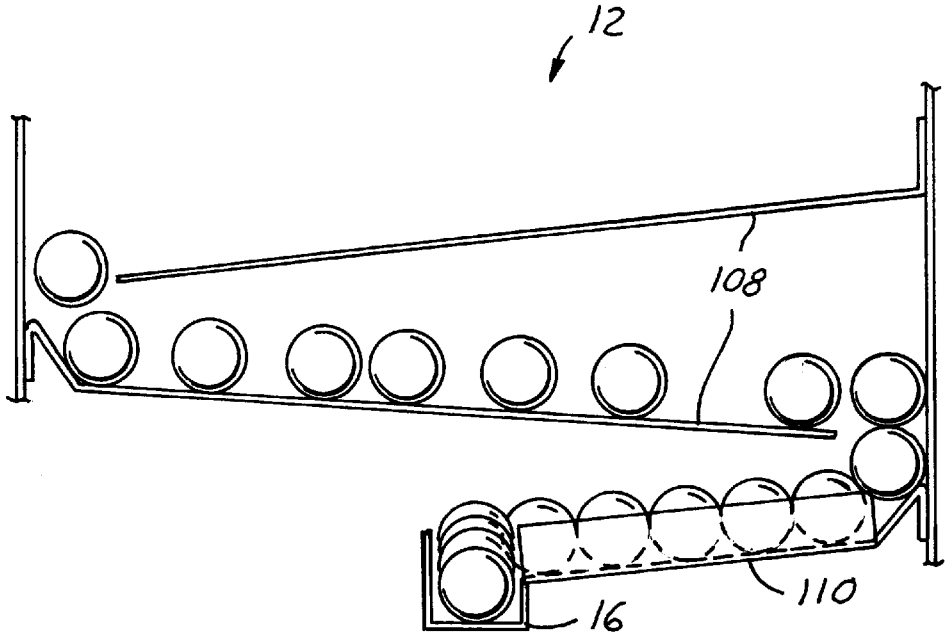
FIG. 12 is a detail illustration of an alternate embodiment of a hopper for use in an automatic mechanical golf ball feed apparatus in accordance with the present invention.
Figure 13:
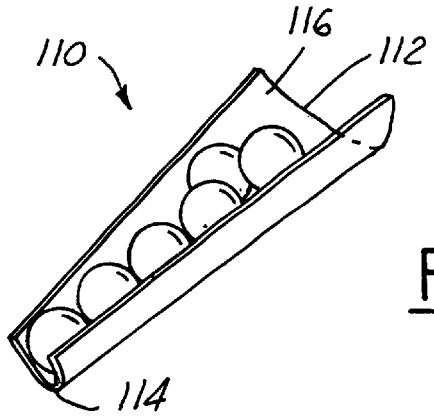
FIG. 13 is a detailed illustration of a clog-free chute element for use in the hopper illustrated FIG. 12.
Figure 14:
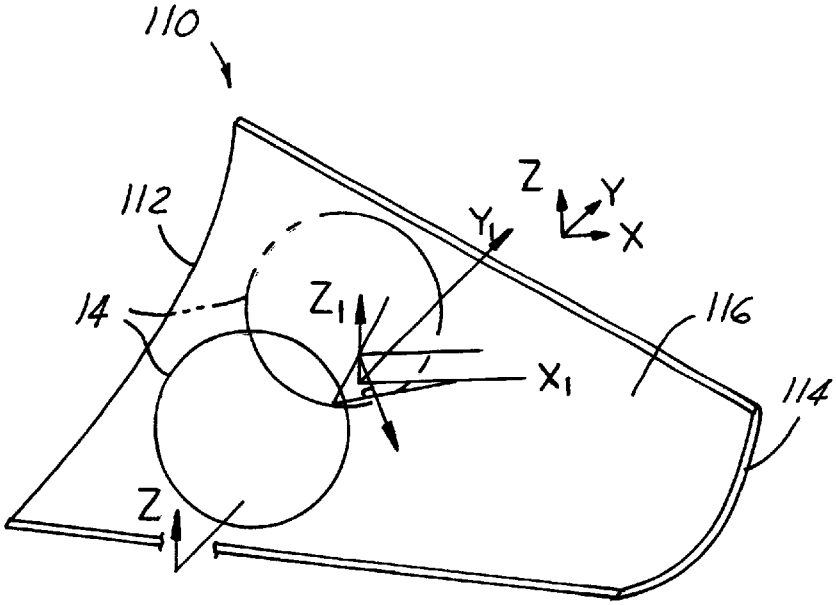
FIG. 14 is a detailed illustration of the clog-free chute element illustrated in FIG. 13, the illustration demonstrating the clog-free nature of the chute design.

The present invention can further include improvements to the hopper 12 such that the plurality of golf balls 14 placed within the hopper 12 and moving through it are controlled such that the incidents of ball clogging are minimized or eliminated. Although a variety of approaches have been taken by prior designs to address the issue of ball-clog prevention, the present invention approaches the prevention through a unique hopper 12 design. The hopper 12 includes a vertically orientated serpentine portion 108. The vertically orientated serpentine portion 108 if preferably wide enough to accommodate multiple golf balls 14 while transporting them in a single ball depth. The vertically orientated serpentine portion 108 feeds the plurality of golf balls 14 into an anti-clog funnel 110. The anti-clog funnel 110 is preferably a horizontally angled conic section 110 having a wide end 112 positioned vertically above a narrow end 114 such that multiple golf balls 14 traverse down the internal conic surface 116 of the horizontally angled conic section 110 from the wide end 112 to the narrow end 114, under the effects of gravity, the golf balls 14 are naturally converted from multiple-ball widths to a single file line of golf balls 14 without clogging. As is illustrated in FIG. 12, when two individual golf balls 14 find themselves akimbo within the horizontally angled conic section 110 the gravitational pull on the center of gravity of the golf balls 14 in combination with the internal conic surface 116 lead to a rotational spinning of one ball ahead of the other rather than developing into a clog. Although not required, the present invention can further include a separate chute element 16 in communication with the narrow end 114 of the horizontally angled conic section 110 such that a single file of golf balls 14 are fed into the chute 16.

While particular embodiments of the invention have been shown and described, numerous variations and alternative embodiments will occur to those skilled in the arm. Accordingly, it is intended that the invention be limited only in terms of the appended claims.

What is claimed is:

1. An automatic mechanical golf ball feed apparatus comprising:

a hopper for housing a plurality of golf balls;

a gravity driven delivery arm including a counterweight end, a ball delivery end and a delivery chamber positioned on said ball delivery end, said gravity driven delivery arm rotatably movable between a loaded position, for receiving one of said plurality of golf balls from said hopper, and a delivery position, for delivering said golf ball to a tee;

a chute in communication with said hopper for dispensing said plurality of balls to said delivery chamber;

an impact gate positioned between said chute and said gravity driven delivery arm, said impact gate including a ball restraint pivot element having a weight biased end, said impact gate rotatable between a gate closed position, wherein said plurality of golf balls are restrained from exiting said hopper, and a gate open position wherein one of said golf balls is allowed to exit said hopper; and a bounce-back restraint assembly, said bounce-back restraint assembly preventing said gravity driven delivery arm from moving away from said hopper prior to receiving one of said plurality of golf balls.

2. An automatic mechanical golf ball feed apparatus as described in claim 1 wherein said bounce-back restraint assembly comprises:

a chamber restraint element for preventing said gravity driven delivery arm from moving away from said hopper, said chamber restraint element designed to engage a chamber restraint feature positioned on said delivery chamber.

3. An automatic mechanical golf ball feed apparatus as described in claim 1 wherein said bounce-back restraint assembly comprises:

a chamber release element for releasing said gravity driven delivery arm after said gravity driven delivery arm receives one of said plurality of golf balls.

4. An automatic mechanical golf ball feed apparatus as described in claim 3 wherein said chamber release element comprises:

a release actuation arm;

a ball actuation arm angularly affixed to said release actuation arm, said release actuation arm and said ball actuation arm rotating about a release pivot, said release actuation arm actuated by one of said plurality of golf balls impacting said ball actuation arm.

5. An automatic mechanical golf ball feed apparatus as described in claim 2 wherein said chamber restraint element comprises:

a chamber restraint arm rotatable about a restraint pivot, said chamber restraint arm designed to engage said chamber restraint feature.

6. An automatic mechanical golf ball feed apparatus as described in claim 2 wherein said chamber restraint feature comprises a triangular catch.

7. An automatic mechanical golf ball feed apparatus comprising:

a hopper for housing a plurality of golf balls;

a gravity driven delivery arm including a counterweight end, a ball delivery end and a delivery chamber positioned on said ball delivery end, said gravity driven delivery arm rotatably movable between a loaded position, for receiving one of said plurality of golf balls from said hopper, and a delivery position, for delivering said golf ball to a tee;

a chute in communication with said hopper for dispensing said plurality of balls to said delivery chamber; and an internal gate positioned within said delivery chamber, said internal gate movable from a closed position to an open position when said gravity driven delivery arm reaches said delivery position;

an actuator tab in remote communication with said internal gate, said actuator tab engaging a restraint when said gravity driven delivery arm reaches said delivery position, said actuator tab upon engaging said restraint forcing said internal gate into said open position.

8. An automatic golf ball feed apparatus as described in claim 7 further comprising:

a mounting structure, said mounting structure serving as said restraint by engaging said actuator tab when said gravity driven delivery arm reaches said delivery position.

9. An automatic mechanical golf ball feed apparatus as described in claim 7 further comprising:

a locking extension formed onto said counterweight end of said gravity driven delivery arm, said locking extension engaging a locking arm when said gravity driven delivery arm is in said loaded position until said golf ball on said tee has been hit or removed.

10. An automatic mechanical golf ball feed apparatus as described in claim 7 wherein said actuator tab is in remote communication with said internal gate by way of an actuator cable.

11. An automatic mechanical golf ball feed apparatus as described in claim 7 wherein said internal gate comprises:

a gate element positioned within said delivery chamber;

a bias spring in communication with said gate element, said bias spring biasing said internal gate into said closed position; and an actuator cable in communication with said gate element, said actuator cable forcing said internal gate into said open position when said gravity driven delivery arm is in said delivery position.

12. An automatic mechanical golf ball feed apparatus as described in claim 7, further comprising:

a baseline pivot arm including a tee end with said golf tee and a lock end, said baseline pivot arm movable between a ball weighted position and a ball free position, said baseline pivot arm biased towards said ball weighted position when one of said plurality of golf balls is positioned on said golf tee and biased towards said ball free position when one of said plurality of golf balls is absent from said tee;

wherein said lock end engages said lock extension when said baseline pivot arm is in the ball weighted position to prevent movement of said gravity driven delivery arm.

13. An automatic mechanical golf ball feed apparatus comprising:

a hopper for housing a plurality of golf balls, said hopper including an anti-clog funnel for converting said plurality of golf balls from a multiple-ball width to a single-ball width, said anti-clog funnel having a wide end and a narrow end, said plurality of golf balls traveling from said wide end to said narrow end along the internal surface of said anti-clog funnel, said anti-clog funnel comprising a horizontally angled conic section;

a vertically orientated serpentine portion, said vertically orientated serpentine portion feeding said plurality of golf balls to said anti-clog funnel in multiple-ball widths and single-ball depth;

a delivery arm including a ball delivery end, said delivery arm rotatably movable between a loaded position and a delivery position; and a delivery chamber positioned on said ball delivery end of said delivery arm, said delivery chamber for delivering one of said plurality of golf balls from said hopper to a golf tee.

14. An automatic mechanical golf ball feed apparatus as described in claim 13, wherein said plurality of golf balls travel along an internal conic surface of said horizontally angled conic section.

15. An automatic mechanical golf ball feed apparatus as described in claim 13 further comprising:

a chute in communication with said anti-clog funnel, said chute receiving said plurality of golf balls from said anti-clog funnel in a single-ball width line.

* * * * *